US007055690B1

(12) United States Patent
Valdez et al.

(10) Patent No.: US 7,055,690 B1
(45) Date of Patent: Jun. 6, 2006

(54) PARTITIONED CARD BOX FOR COLLECTIBLE CARDS AND TREATED WITH FRICTION REDUCING MEANS

(76) Inventors: Dominic M Valdez, 12120 Orgren Ave., Chino, CA (US) 91710; Yolanda Valdez, 12120 Orgren Ave., Chino, CA (US) 91710

( * ) Notice: Subject to any disclaimer, the term of this patent is extended or adjusted under 35 U.S.C. 154(b) by 110 days.

(21) Appl. No.: 10/790,937

(22) Filed: Mar. 1, 2004

(51) Int. Cl.
*B65D 85/00* (2006.01)

(52) U.S. Cl. ..... 206/449; 206/215

(58) Field of Classification Search ..... 206/449, 206/214, 38, 730–735, 459.5, 215, 453; 220/504, 220/826
See application file for complete search history.

(56) References Cited

U.S. PATENT DOCUMENTS 1,693,622 A * 12/1928 Spaulding ..... 206/732
2,430,707 A * 11/1947 Cahn ..... 206/315.1
2,533,577 A * 12/1950 Godfrey ..... 206/315.1
2,591,271 A * 4/1952 Levereth ..... 220/504
3,061,136 A * 10/1962 Sterngart ..... 220/504
3,351,209 A * 11/1967 Kofoed et al. ..... 206/449
3,842,974 A * 10/1974 Jacobsen ..... 206/449
4,095,361 A 6/1978 Ledenican
4,145,826 A 3/1979 Shaw
4,182,061 A 1/1980 English
4,212,124 A 7/1980 Gammill
4,531,316 A 7/1985 Farnum
4,778,056 A * 10/1988 Faulstick et al. ..... 206/449
4,829,691 A 5/1989 Manjos et al.
4,979,619 A 12/1990 Hager
5,092,062 A 3/1992 Palka
5,097,953 A 3/1992 Gingras
5,224,600 A 7/1993 Neugebauer
5,249,383 A 10/1993 McCusker et al.
5,259,136 A 11/1993 Goserud
5,358,114 A 10/1994 Neugebauer
5,522,163 A 6/1996 Neugebauer
5,651,202 A 7/1997 Hewitt
5,878,878 A * 3/1999 Wu ..... 220/4.22
5,911,320 A * 6/1999 Forestelle ..... 206/215
5,979,097 A 11/1999 Moore
6,032,394 A 3/2000 Hand et al.
6,149,003 A 11/2000 Day
6,325,292 B1 12/2001 Sehr
6,737,974 B1 * 5/2004 Dickinson ..... 206/459.5
2002/0069567 A1 6/2002 Marino
2002/0129527 A1 9/2002 Vaudreuil
2002/0179478 A1 * 12/2002 Silvers ..... 220/504
2003/0029764 A1 * 2/2003 Vihos ..... 206/449
2003/0033745 A1 2/2003 Ribaudo
2003/0230514 A1 * 12/2003 Baker ..... 206/732

* cited by examiner

*Primary Examiner*—Bryon P. Gehman

(57) ABSTRACT

A display and storage apparatus for suitably holding collectible cards comprising a partitioned card box having a first card holder with a first holder cap at a first side of the partitioned card box and a second card holder with a second holder cap located at an opposite second side of the partitioned card box. The first holder cap comprises a latch or locking mechanism for storing at least one collectible card securely inside the first card holder.

20 Claims, 7 Drawing Sheets

PARTITIONED CARD BOX FOR COLLECTIBLE CARDS AND TREATED WITH FRICTION REDUCING MEANS

FIELD OF THE INVENTION

The invention herein described relates generally to collectible card display holders. More particularly, the invention is directed to a partitioned card box with one cardholder for card display/viewing and another cardholder for card storage.

BACKGROUND OF THE INVENTION

Sometimes, cards were simply kept in readily available cigar boxes or check boxes. Routine handling and reshuffling tended to wear and damage valuable collectible cards. As more people began to collect such cards, rare or early cards have become quite valuable and collectible. In particular, cards bearing an original autograph of the subject and cards showing rookie players who later become stars can be extremely valuable. Collectors began to store the cards in paper sleeves, envelopes or plastic bags to protect them from incidental damage. Ideally, the cards would be stored in a manner allowing viewing of the cards while protecting them against physical damage. Plastic sleeves protect against wear quite well, but generally do not protect against bending or ultraviolet fading. Thus, conventional storage methods do not provide maximum protection while allowing the card image to be viewed or displayed.

The displaying and collecting of favorite cards, such as sports cards or non-sports cards, collectively referred to as "flat card", is known. There are various types of prior art cardholders and display means for flat cards. One example is U.S. Pat. No. 6,149,003 issued on Nov. 21, 2000 to Day, entire contents of which are incorporated herein by reference, discloses a card protection system comprising a transparent card holder and a light impervious pouch for containing in the holder. The card holder comprises front and back transparent sheet walls, upstanding ribs formed on at least one inner wall surface surrounding spaces corresponding to the dimensions of a card and a certificate of authenticity to be held in selected positions therein. The front and back walls can be bonded together by ultrasonic welding, adhesive bonding or the like after the card and certificate have been placed therein. The card holder is distinguishable with bonded front and back sheet walls that cannot be opened without damage to the holder.

U.S. Pat. No. 6,325,292 issued on Dec. 4, 2001 to Sehr, entire contents of which are incorporated herein by reference, discloses a card system and methods that encompass a card issuer entity and a plurality of service providers so as to automatically compile, issue, utilize, and process collector cards for the purpose of enjoyment, purchase of goods and services, and for the activation of other card-based privileges. The portable collector cards are realized by smart card technology and have the ability to compile and process collectible information, and store and use a monetary amount to simulate debit/credit card payment means. Sehr patent is distinguishable with biometrics identification of cardholders with desired database information.

U.S. Pat. No. 5,249,383 issued on Oct. 5, 1993 to McCusker et al., entire contents of which are incorporated herein by reference, discloses a plastic display device for holding and protecting a card or card-like display item comprising a rectangular frame structure with a chamber means of sufficient size for receiving a card or card-like display item. The frame structure further comprises groove means horizontally disposed along the front section below the chamber and a corresponding groove means disposed along the base section whereby the base sections can be detached to provide removal of a card display item from the chamber means. The display device is distinguishable with its groove means for insertion and removal of a card display item.

Further, U.S. Pat. No. 5,097,953 issued on Mar. 24, 1992 to Gingras, entire contents of which are incorporated herein by reference, discloses a card holding device which comprises a lower section and an upper section. The lower section comprises a female surface having a recessed portion having a depth for receiving a card, the depth being approximately equal to the thickness of the card and the upper section comprises a male surface that has a raised central portion which presses against a sport card secured in an inner frame portion of the lower section. The card holding device is distinguishable with its two sectional frames for holding flat cards.

U.S. Pat. No. 4,145,826 issued on Mar. 27, 1979 to Shaw, entire contents of which are incorporated herein by reference, discloses a display holder with a frame having front and rear walls between which a plate is inserted and positioned against the inner side of the front wall, wherein the front wall is apertured to permit viewing of the plate therethrough and means on the rear wall is provided for supporting the plate in a vertical position at three points. The rear wall has a pair of abutment elements adapted to engage the rear side of such article at horizontally spaced apart points along the lower portion of the plate when the plate is so positioned. The Shaw display holder is distinguishable with a supporting arrangement to maintain the plate in a vertical position and ready assembly with adhesives or sealants.

U.S. Pat. No. 4,182,061 issued on Jan. 8, 1980 to English, entire contents of which are incorporated herein by reference, discloses a display frame with at least two different display areas within the frame for exhibiting in one area a two-dimensional object and in another area a three-dimensional object. The display tray defines a concave surface facing the transparent sheet material and forming with the transparent sheet material a space for receiving a three-dimensional object. The English display frame is distinguishable with the special display tray used to cradle the three-dimensional object so that the object can be exhibited through the display frame.

U.S. Pat. No. 5,092,062 issued on Mar. 3, 1992 to Palka, entire contents of which are incorporated herein by reference, discloses a display device for holding and exhibiting placards and the like such as business cards, wherein a plurality of card-receiving pockets are arranged on the front face of a main plate-like body. Each pocket is capable of receiving a plurality of placards in the form of a stack or batch so as to maintain such placards in a neat upright stack with the outer face of the outermost placard of the stack clearly visible to a casual observer. More specifically, the display device has an open-topped pockets arranged with three flanges per pocket. The display device is distinguishable with its open pockets for flat cards.

U.S. Pat. No. 4,212,124 issued on Jul. 15, 1980 to Gammill, entire contents of which are incorporated herein by reference, discloses a frame for wall-mountable displays including a plurality of nails with first heads at the driven end of the nail and second heads axially displaced from the first heads. A resilient structure for supplying directional pressure, such as tension spring wires, is located between the two heads radially extending beyond the first heads when expanded. The Gammill frame is distinguishable with tension spring wires expanded to hold the frame in place by resilient action.

U.S. Pat. No. 4,095,361 issued on Jun. 20, 1978 to Ledenican, entire contents of which are incorporated herein by reference, discloses a display frame for holding a flat member having a separable frame portion separably secured thereto in a manner permitting separation only by an authorized person having a special tool. The separable frame portion is separably secured to the holding frame portion by separable joints, at least one of which includes a locking member completely concealed within the frame and having a movable latch portion yieldably urged to a locked position and being movable to a released position. The display frame is distinguishable with its concealed locking mechanism preventing from separating the frame unauthorized.

U.S. Pat. No. 5,651,202 issued on Jul. 29, 1997 to Hewitt, entire contents of which are incorporated herein by reference, discloses an expandable display device and sports cardholder arranged in the frame. The cardholder includes two matching transparent panels engaged to hold the card-like object. Indentations in the panels at a periphery edge thereof provide a cutout gripping portion enabling the card holder to be manually grasped by inserting a portion of a finger into the cutout portion. A second embodiment of a transparent cardholder comprises two joined transparent rectangular sides having an access notch in the front and two magnetic strips underneath to attach the holes to the metal backing members. The cardholder is distinguishable with its two dissimilar parts which must have magnetic strips for mounting on the metal backing panels in the metal frame.

U.S. Pat. No. 4,531,316 issued on Jul. 30, 1985 to Farnum, entire contents of which are incorporated herein by reference, discloses an economical frame for photographs, visual displays and three-dimensional objects comprising an envelope with a cropping guide for cropping the display thru a cropped area, when uncropped, protecting the envelope from tearing or damage. The Farnum economical frame is distinguishable with its cropping guide means that, when uncropped, protecting the envelope with a three-dimensional object from tearing or damage.

U.S. Pat. No. 4,829,691 issued on May 16, 1989 to Manjos et al., entire contents of which are incorporated herein by reference, discloses a display device and protector for suitably holding a card-like object comprising two transparent panels connected along a common hinge line, wherein the first panel has a recess area matching the projection area of the second panel allowing display of the card. The Manjos et al. device is distinguishable with two suitably matching panels for holding the card in between the recess and the projection.

U.S. Pat. No. 4,979,619 issued on Dec. 25, 1990 to Hager, entire contents of which are incorporated herein by reference, discloses a protective case for collectible sport cards comprising front and rear panels of matching elongated rectangular perimeter adapted to be cohesively sealed to enclose a sports card. The Hager case is distinguishable with dimensions of the case relative to the sports card such that the sports card within a sealed case is free to move slightly.

U.S. Pat. No. 5,224,600 issued on Jul. 6, 1993, U.S. Pat. No. 5,358,114 issued on Oct. 25, 1994, and U.S. Pat. No. 5,522,163 issued on Jun. 4, 1996, all to Neugebauer that entire contents of all three are incorporated herein by reference, disclose a card holder having a transparent base with a lip extending around the periphery of the base thereby forming a pocket for receiving a card. The card holder may comprise a base with a slot therein and a cover with a flange extending from the cover, wherein the flange on the cover engages the slot in the base enabling the threaded fastener engages apertures in both the base and cover to secure the card holder in a closed position. The Neugebauer card holder is distinguishable with a sealed or fastened mechanism for holding the two panels together.

U.S. Pat. No. 5,259,136 issued on Nov. 9, 1993 to Goserud, entire contents of which are incorporated herein by reference, discloses a holder for a collectible card comprising a jacket of two panels with three of the edges bonded together and the remaining edge as an entrance opening to the jacket, and a flexible thin insert member completely fills the jacket except for an aperture defined by four straight interior edges serving to retain a collectible card within the aperture, preventing inadvertent release of the card from the aperture. The Goserud holder is distinguishable with four straight interior edges within the jacket.

U.S. Pat. No. 5,979,097 issued on Nov. 9, 1999 to Moore, entire contents of which are incorporated herein by reference, discloses a display device kit utilizing a card holder in combination with an angled frame to provide a protective, aesthetically pleasing, versatile display of a collectible card. The display device further provides means for viewing at least a portion of the cards through the frame. The Moore display device is distinguishable with a transparent frame for viewing of at least a portion of side of the item through a viewing region in each of the front and rear panels.

U.S. Pat. No. 6,032,394 issued on Mar. 7, 2000 to Hand et al., entire contents of which are incorporated herein by reference, discloses a placard holder utilizing a mounting plate which confines the placard in a certain position, wherein a plurality of pins are linked to the mounting plate and are capable of passing through the body. A backing member engages the pins through a plurality of apertures. The pins are held in place by a fixation member. The Hand et al. placard holder is distinguishable with a holder for fixing a placard to a body which is durable and versatile.

US Patent Application No. 2003/0033745 by Ribaudo that is published on Feb. 20, 2003, entire contents of which are incorporated herein by reference, discloses a display system having a substantially flat front portion for holding and displaying memorabilia. The display system comprises a frame, a backing supported by the frame, a plurality of cardholders for holding photographic memorabilia and a recessed chamber for holding an object of memorabilia associated with the photographic memorabilia. The cardholders are arranged about the chamber in an aesthetic manner. The Ribaudo patent application is distinguishable with a cardholder that retains trading cards and is attachable to the backing.

U.S. Patent Application No. 2002/0069567 by Marino that is published on Jun. 13, 2002, entire contents of which are incorporated herein by reference, discloses a display frame for displaying encased sports cards and the like with a glass pane, a pre-frame of wood or plastic having a cutout port for each card encased in an inflexible transparent plastic card holder, and an inflexible cardboard backing layer. The card display frame is distinguishable with its capability of holding up to one hundred flat cards within the frame.

Further, US Patent Application No. 2002/0129527 by Vaudreuil that is published on Sep. 19, 2002, entire contents of which are incorporated herein by reference, discloses a card holder for securely linking together an identification card to a validation card so as to prevent fraudulent removal of the identification and validation cards once the latter have been inserted into the card holder. The Vaudreuil card holder is distinguishable with means for displaying the first identification card and the second validation card in an offset relationship relative to each other allowing simultaneous display of both cards.

None of the above inventions and patents, taken either singly or in combination, is seen to describe the instant invention as specified and claimed, particularly the partitioned card box with a first cardholder portion for card display and a second cardholder portion for card storage, whereas the first cardholder is easily ready for inserting, storing, protecting and removing a valuable collectible card.

While such prior devices provide improvement in the area intended, they all related to some kind of assembly for displaying card-type objects. The main different feature of a partitioned card box is its protected display cardholder and separated storage cardholders. In some aspect, it is provided a partitioned/split card box with individual holder caps to each cardholder, whereas the outer face of the display card is clearly visible to a casual observer.

SUMMARY OF THE INVENTION

It is one object of the present invention to provide a card display apparatus for suitably displaying, holding, and protecting valuable collectible cards, such as baseball cards.

It is another object of the present invention to provide a card display apparatus for suitably holding collectible cards comprising a partitioned card box having a first card holder portion with a first holder cap at a first side of the partitioned card box and a second card holder portion with a second holder cap located at an opposite second side of the partitioned card box. In one embodiment, the first holder cap comprises a latch or locking mechanism for storing at least one collectible card securely inside the first card holder. In another embodiment, the display apparatus further comprises a second latch or locking mechanism on the second holder cap for storing a balance of the collectible cards securely inside the second card holder.

It is still another object of the present invention to provide a display apparatus comprising a partitioned card box with at least one card holder that is transparent for display and viewing. In one embodiment, at least one of the card holders is coated with UV protective material, or color coded for card-type identification. The display apparatus of the invention is made of a material selected from a group consisting of polyvinyl chloride, polyester, polycarbonate, polystyrene, polyether, acrylic, poly(methyl methacrylate), mixtures thereof, and other transparent plastics.

In some aspect of the present invention, it is provided a display apparatus comprising a partitioned card box having a first and a second card holders, wherein at least one of the card holders comprises a recessed portion having card-fitting dimensions for holding the cards, wherein the card-fitting dimensions are sized and configured to allow grasping means for picking up an edge of the cards from the at least one of the card holders. The card-fitting recessed portion of the card holder comprises a first depth for holding one card, wherein the first depth is equal to or slightly larger than the thickness of the card.

Some aspects of the invention relate to a display apparatus comprising a partitioned card box having a first and a second card holders, wherein at least one of the card holders comprises a recessed portion having card-fitting dimensions for receiving the cards to be held, wherein the card-fitting dimensions comprise a depth and a pair of four sides, each of the four sides comprising two parallel longitudinal sides and two parallel traverse sides forming a rectangle, wherein at least one of the four sides has a solid rectangular riser attached to that side. The riser is a raised side portion, also known as an uprising rib, for abutting against respective edge of the card, having dimensions of a riser height, a riser length and a riser width. Preferably, the space between ends of two rectangular risers of the display apparatus is sized, dimensioned and configured for allowing the cards to be removed from the at least one card holder by the grasping means for picking up an edge of the cards.

In still another aspect, it is provided a method of holding and displaying collectible cards comprising: providing a partitioned card box having a first card holder with a first holder cap at a first side of the partitioned card box and a second card holder with a second holder cap located at an opposite second side of the partitioned card box, wherein the first holder cap comprises a first latch mechanism and the second holder cap comprises a second latch mechanism; turning the first card holder in an essentially upright position and storing at least one collectible card inside the first holder and applying the first latch mechanism to securely holding the card; turning the partitioned card box to enable the second card holder facing upward in an essentially upright position; and storing a balance of the collectible cards inside the second holder and applying the second latch mechanism to securely holding the balanced collectible cards.

BRIEF DESCRIPTION OF THE DRAWINGS

Additional objects and features of the present invention will become more apparent and the invention itself will be best understood from the following Detailed Description of Exemplary Embodiments, when read with reference to the accompanying drawings.

DETAILED DESCRIPTION OF EXEMPLARY EMBODIMENTS

Figure 1:
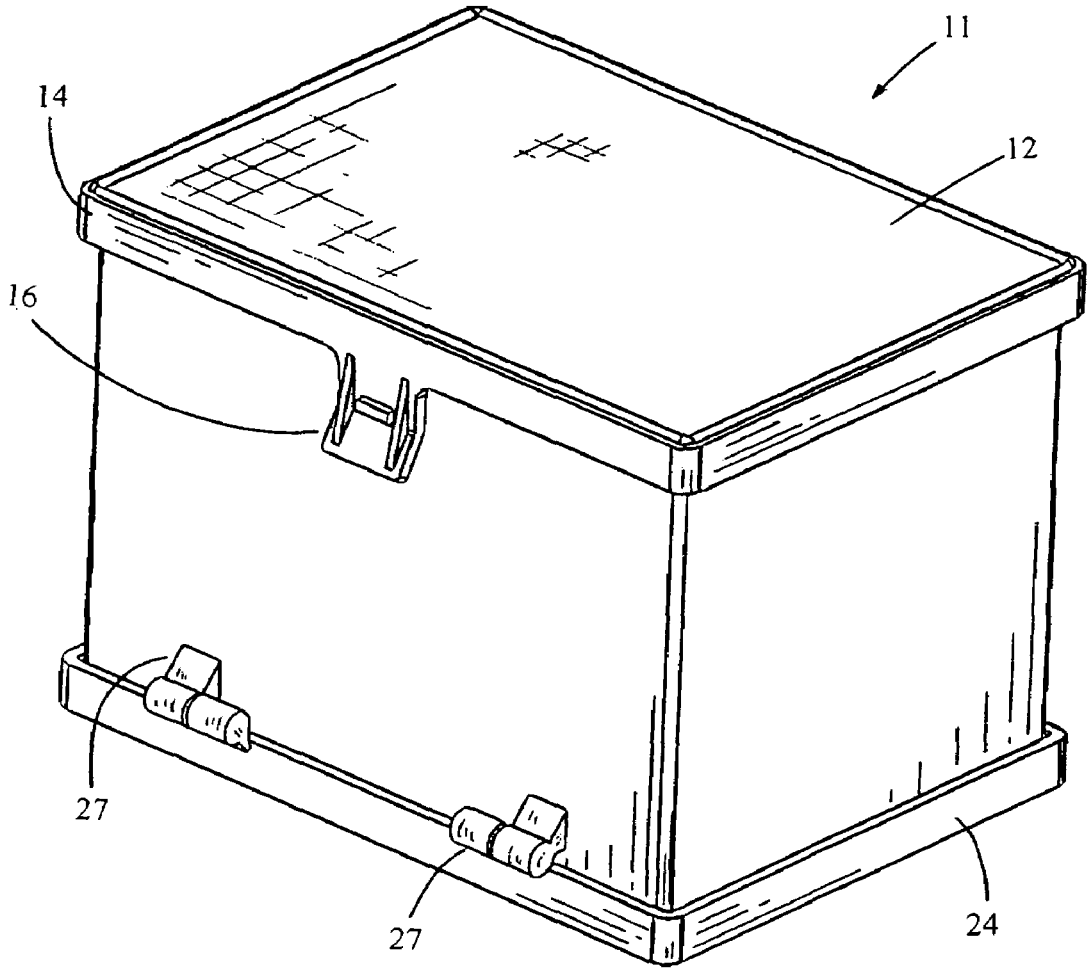
FIG. 1 is a perspective view of a display apparatus comprising a partitioned card box having a first card holder with a first holder cap at a first side of the partitioned card box and a second card holder with a second holder cap located at an opposite second side of the partitioned card box according to the principles of the present invention.

The preferred embodiments of the present invention described below relate particularly to a display apparatus for suitably holding collectible cards comprising a partitioned card box having a first card holder portion with a first holder cap at a first side of the partitioned card box and a second card holder portion with a second holder cap located at a second side of the partitioned card box, whereas the second side may be opposite to the first side. In this invention, the partitioned card box is also known as "a split card box" or "a divided card box". While the description sets forth various embodiment specific details, it will be appreciated that the description is illustrative only and should not be construed in any way as limiting the invention. Furthermore, various applications of the invention, and modifications thereto, which may occur to those who are skilled in the art, are also encompassed by the general concepts described below.

Referring to FIGS. 1 to 7, what is shown is an embodiment of a display apparatus or holder device for suitably holding collectible cards or card-like object comprising a partitioned card box having a first card holder with a first holder cap at a first side of the partitioned card box and a second card holder with a second holder cap located at an opposite second side of the partitioned card box. In one aspect, the first card holder is mainly for displaying and viewing a collectible card and the second card holder is for storing and holding a plurality of collectible cards. Both card holders have certain spaces or recessed portion having suitably card-fitting dimensions for receiving the card(s) to be held. In a further embodiment, the second cap may be located at a side different from the first side.

The apparatus or holder device of the invention may be made of thermoplastic, thermosetting, or non-plastic material selected from a group consisting of polyvinyl chloride, polyester, polycarbonate, polystyrene, polyether, acrylic, polymethylmethacrylate, mixture thereof, and the like. The holder may be made of a plastic and/or a non-plastic material with at least a transparent card viewing section or a transparent card viewing holder cap. A conventional molding process or other manufacturing processes could be used to fabricate the apparatus.

The cap of the card holders of the display apparatus may be transparent for display and viewing purposes. However, at least one holder, a cap, or a portion of the holder or cap may be treated or coated with UV protective material for protecting the collectible cards from ultraviolet (UV) or light exposure. The UV protective material and methods of applying the UV protective material are well known to one skilled in the art, for example, U.S. Pat. No. 6,616,935 issued on Sep. 9, 2003. For card-type identification, the at least one holder, the holder cap, or the partitioned card box may be color coded or equipped with means for card identification, inventory, and tracing with an electronic system, the means being selected from a group consisting of readable chips with preloaded data, embedded microchips 57, 58 with preloaded data, RF identifiers 59, barcodes, and other electronic or mechanical coding systems.

Figure 2:
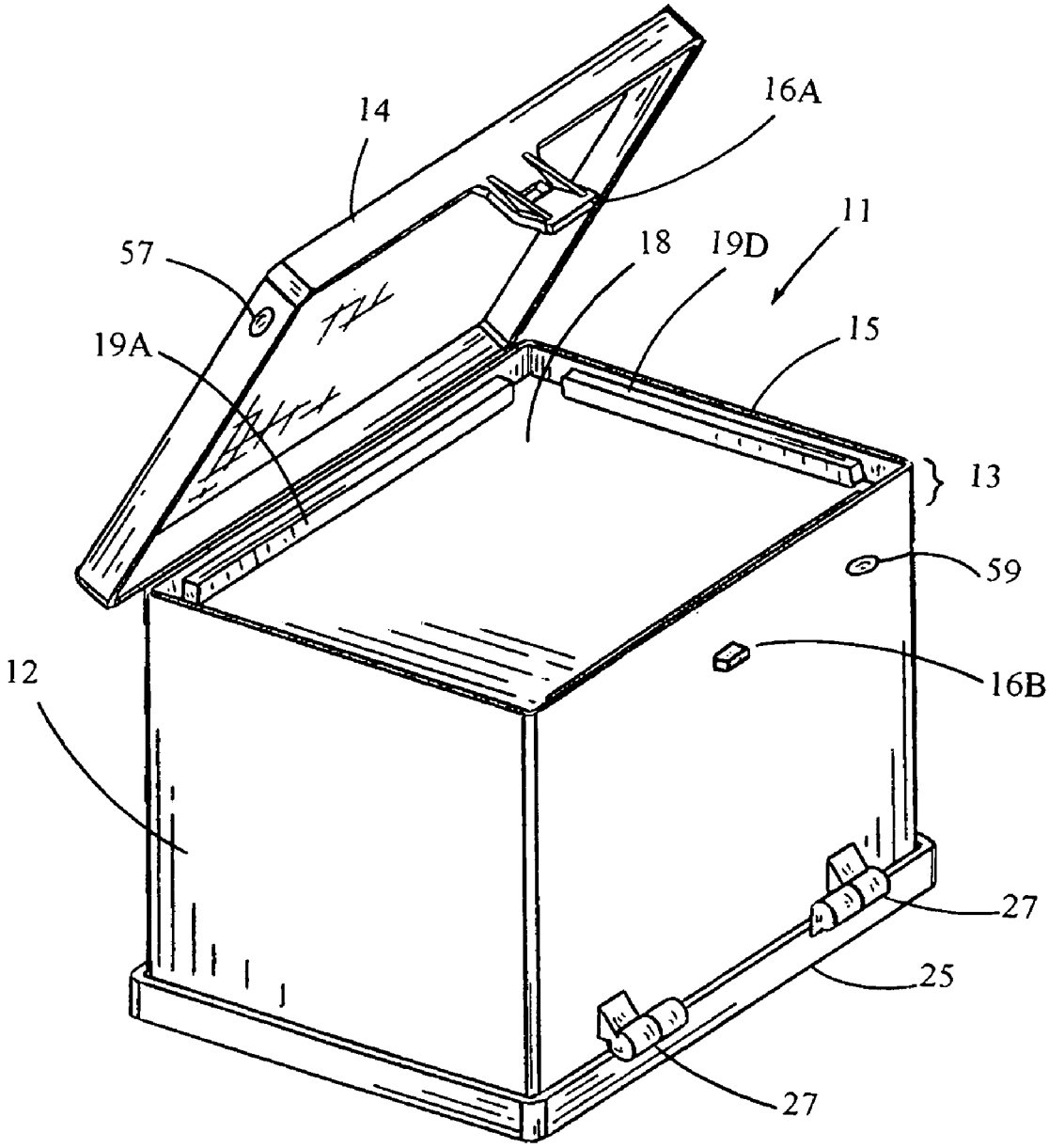
FIG. 2 is another perspective view of the display apparatus of FIG. 1, comprising a partitioned card box having a first card holder with a first holder cap at a first side of the partitioned card box at an open position.
Figure 3:
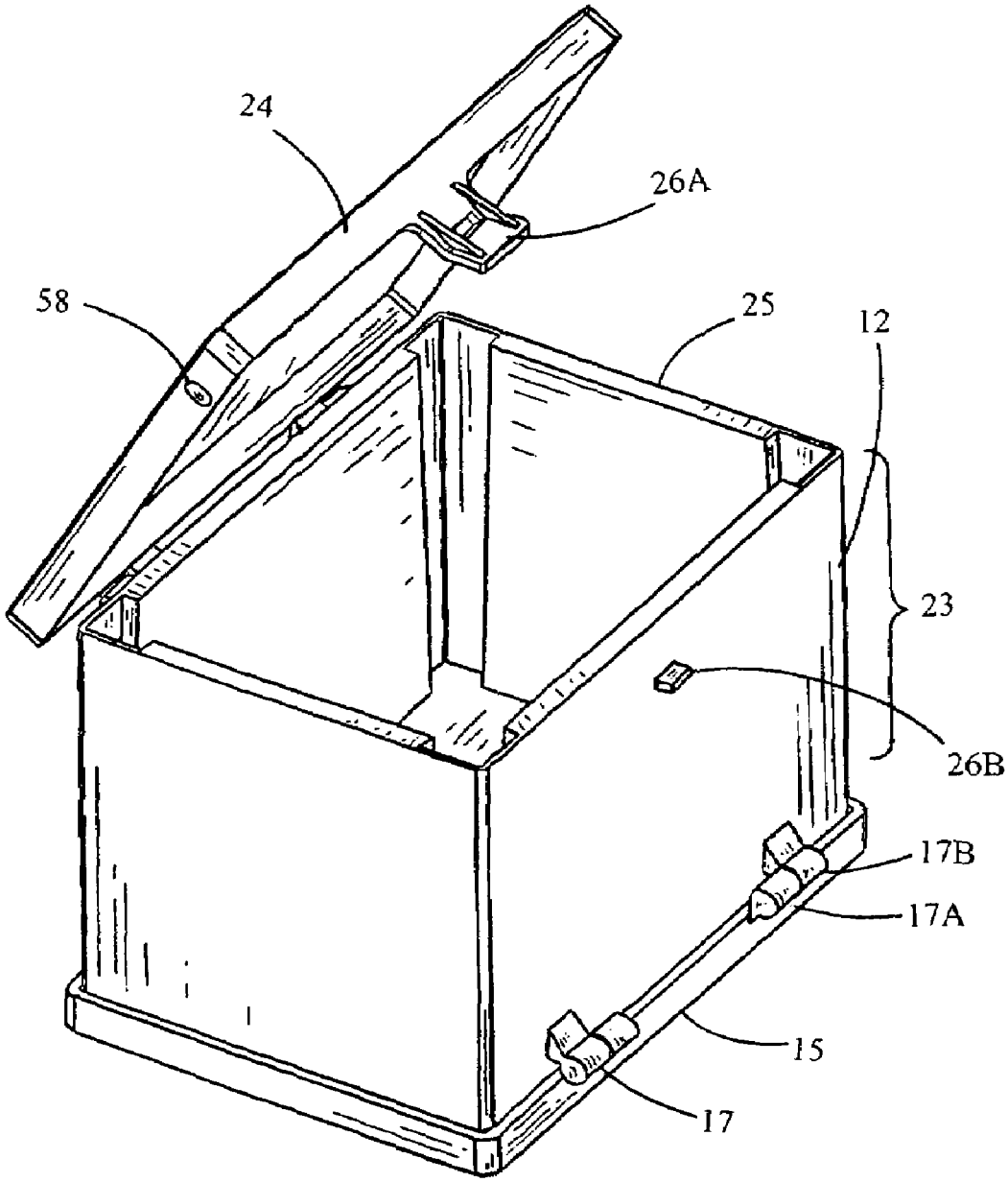
FIG. 3 is still another perspective view of the display apparatus of FIG. 1, comprising a partitioned card box having a second card holder with a second holder cap located at an opposite second side of the partitioned card box at an open position.

FIGS. 1–3 show various perspective views of a display apparatus 11 comprising a partitioned card box 12 having a first card holder 13 with a first holder cap 14 at a first side 15 of the partitioned card box and a second card holder 23 with a second holder cap 24 located at a second side 25 that is opposite to the first side 15. Sometimes, the first card holder 13 is on top of the second card holder 23 when the partitioned card box is in certain upright position. In one embodiment, the first holder cap 14 comprises a latch 16 or locking mechanism for storing at least one collectible card securely inside the first card holder 13. In another embodiment, the apparatus comprises a second latch or locking mechanism on the second holder cap 24 for storing a balance of the collectible cards securely inside the second card holder 23.

By way of examples, one suitable latching means for latching the holder cap to the card holder may comprise a latching arrangement, including a female element 16A of the latching arrangement on the holder cap 14 and a matching male element 16B of the latching arrangement on the holder of the partitioned card box 12 (see FIG. 3). Similarly, the suitable latching means may comprise a female element 26A of the latching arrangement on the holder cap 24 and a matching male element 26B of the latching arrangement on the holder 23 of the partitioned card box 12.

In one embodiment, at least one integral hinge 17, 27 is secured to or molded into the partitioned card box 12 whereas the hinge connects the holder cap 14, 24 to the side of the partitioned card box for allowing the holder cap to open or close in reference to the hinge line as needed. By way of example, the integral hinge 17 comprises a first hinge element 17A which is secured to the holder cap 14 and a second hinge element 17B which is secured to the card holder 13. By coupling the two hinge elements 17A, 17B together, the holder cap 14 is able to swing about the hinge line for opening or closing the cap.

Figure 4A:
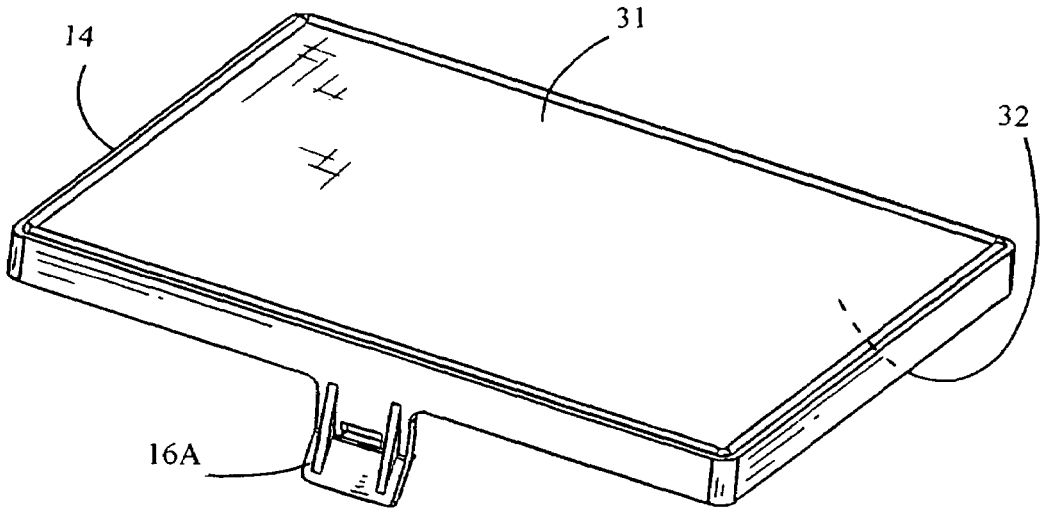
FIG. 4A is a perspective view of a holder cap for the card holder that is viewed from an exterior side of the cap.
Figure 4B:
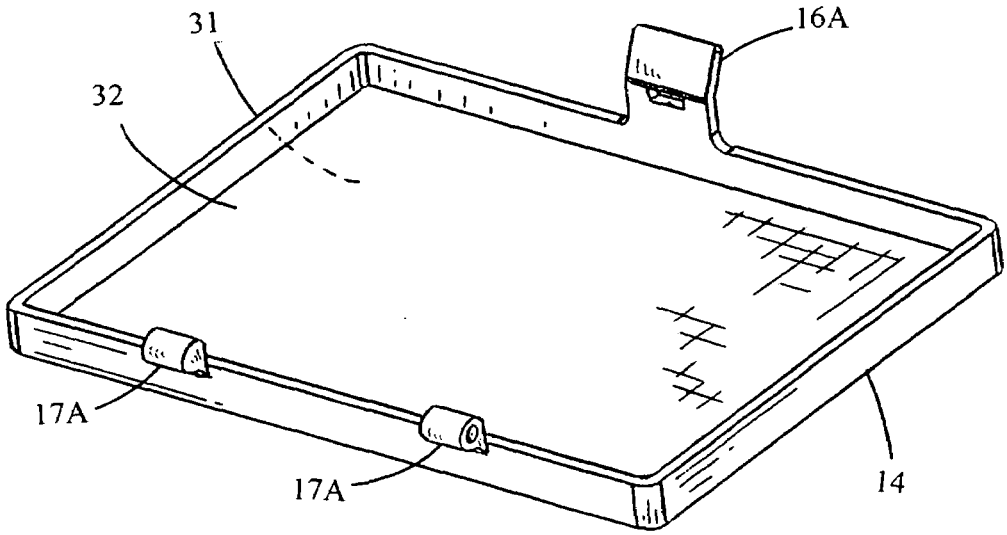
FIG. 4B is a perspective view of a holder cap for the card holder that is viewed from an interior side of the cap.

FIG. 4A shows a perspective view of a holder cap 14 (or 24) for the card holder that is viewed from an exterior side 31 of the cap, while FIG. 4B shows a perspective view of a holder cap for the card holder that is viewed from an interior side 32 of the cap. The identification method, such as color coding, an embedded microchip, a barcode, or an RF identifier with pre-loaded data for card identification, inventory, and tracing with an electronic recognition system is usually placed at approximately the exterior side 31 of the cap, on the holder, or on the partitioned card box that is easily identifiable, readable or accessible. In some aspect, the interior and/or exterior surfaces of the holder cap may be appropriately textured or relatively smooth so the collectible cards in the card holders could be stored, displayed, and protected.

Figure 5:
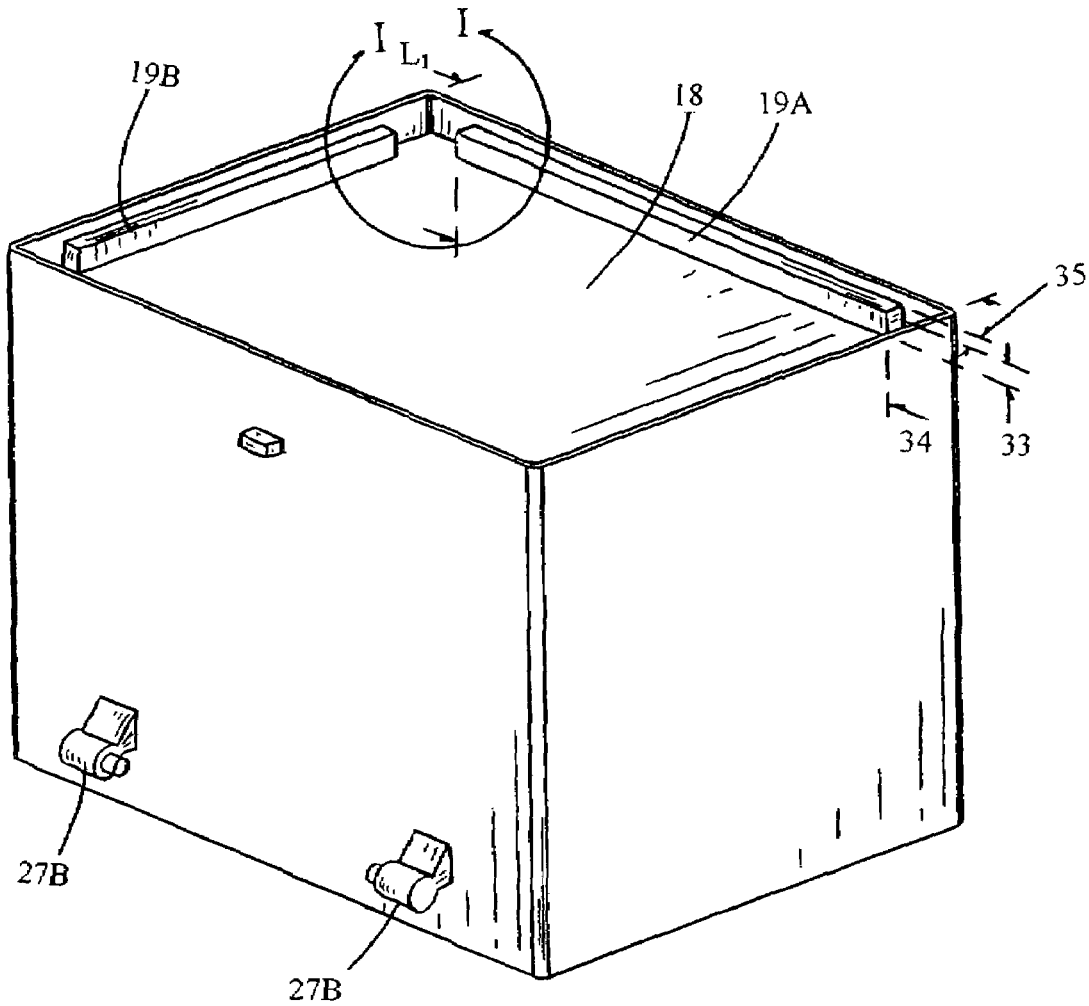
FIG. 5 is a top perspective view of the display apparatus comprising a partitioned card box having a first card holder with card-fitting dimensions.

FIG. 2 shows another perspective view of the display apparatus 11 of FIG. 1, comprising a partitioned card box having a first card holder 13 with a first holder cap 14 at a first side 15 of the partitioned card box at an open position. Further, FIG. 5 shows a top perspective view of the display apparatus comprising a partitioned card box having a first card holder with card-fitting dimensions (without showing the holder cap for illustration). By way of illustration, the first card holder 13 comprises a card-fitting recessed portion that is bordered by the separating plate 18, the risers and the interior surface 32 of the first holder cap 14. The separating plate 18 is located within the partitioned card box 12 and serves to separate the cards in the first card holder 13 and in the second card holder 23.

Figure 6:
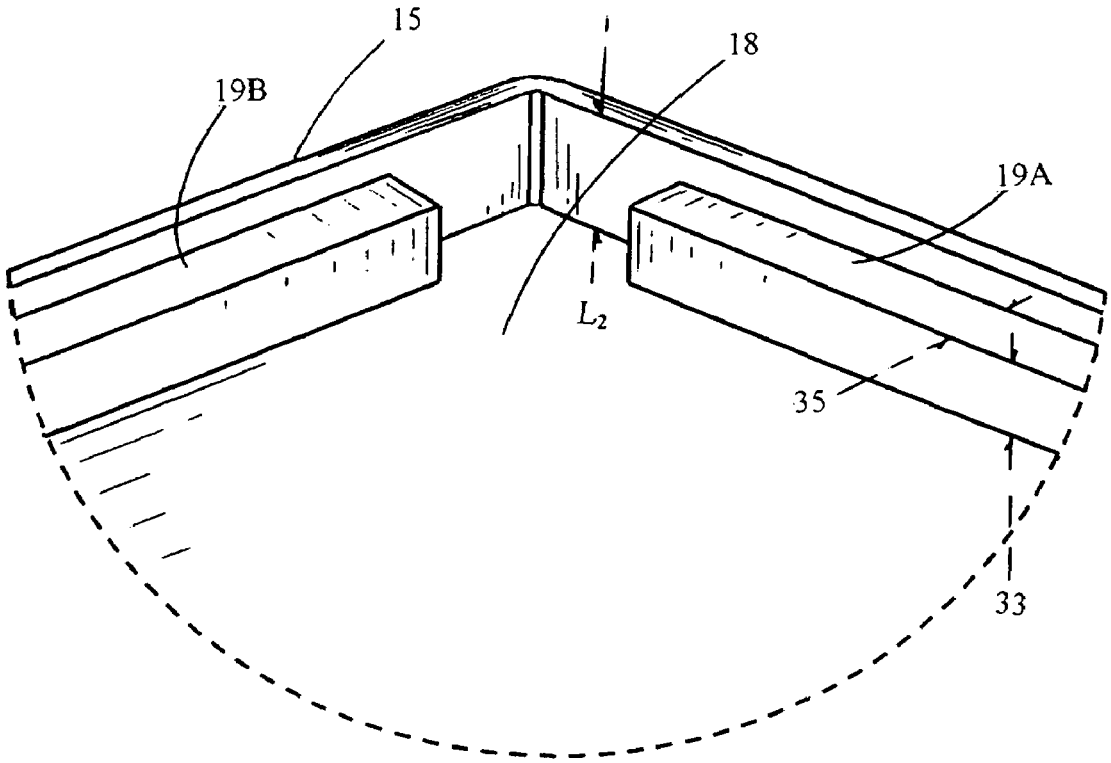
FIG. 6 is a perspective view, section I—I of FIG. 5, illustrating the card-fitting dimensions and accompanying rectangular risers, the riser having dimensions of a riser height, a riser length and a riser width.

In some aspects of the present invention, the card-fitting dimensions have raised side portions (that is, risers) suitably for abutting against respective edges of the card, depending on the shape of the card. The "card-fitting dimensions" are herein intended to mean that the length and width dimensions of the card holding space have the sides for matching and suitably abutting against respective edges of the card. The "riser" (that is, an uprising rib) of the invention is intended to mean a shaped object having dimensions of a riser height, a riser length, and a riser width, preferably in a rectangular shape. FIG. 6 shows a perspective view, section I—I of FIG. 5, illustrating the card-fitting dimensions and accompanying rectangular risers (19A, 19B, 19D). For example, the riser 19A has dimensions of a riser height 33, a riser length 34, and a riser width 35. In one embodiment, the riser may be shaped, sized, and surface modified to appropriately receive a collectible card or cards of any shape or size. In another embodiment, the riser surface may be treated with friction reducing means, such as Teflon coating, for enabling easier card insertion and/or removal and for minimizing unintentional card damage.

One aspect of the invention relates to the riser height 33 equal to or slightly less than the height (or depth) of the card-fitting dimensions ($L_2$ in FIG. 6). Further, another aspect of the invention relates to the riser length 34 slightly less than the length of the card-fitting dimensions ($L_1$ in FIG. 5). It is one object to provide the card-fitting dimensions of the card holder comprising a first depth $L_2$ for receiving one card or more cards of similar dimension to be held, wherein the first depth is equal to or slightly larger than the thickness of the one card. It is another object to provide at least one of the card holders comprising a recessed portion having card-fitting dimensions for receiving the cards to be held, wherein the card-fitting dimensions are sized, shaped, and configured to allow grasping means for picking up an edge or a corner of the cards from the at least one of the card holders. In one aspect, the card-fitting or card-matchable dimensions may include indentations in the card holder at a periphery edge thereof that provide a cutout gripping portion enabling the card holder to be manually grasped by inserting a portion of a finger into the cutout portion. The grasping means may include using a finger, a pair of tweezers, a picker tool, a spatula, a lifter, forceps, or the like.

In one preferred embodiment, the card-fitting dimensions comprise a depth and a pair of four sides, each of the four sides comprising two parallel longitudinal sides and two parallel traverse sides, wherein at least one of the four sides has a solid rectangular-like riser, the riser having dimensions of a riser height, a riser length, and a riser width. One object of the invention is to allow the rectangular-like riser being sized, dimensioned, and configured for allowing the cards to be removed from the at least one card holder by the grasping means for picking up an edge or an corner of the cards. However, for displaying a non-rectangular card, the card-fitting dimensions are properly sized and configured conformable to the size and shape of the non-rectangular card. In one embodiment, the riser may have a non-rectangular shape, such as a triangle shape, a trapezoid shape, a semi-circular shape, or the like.

Figure 7:
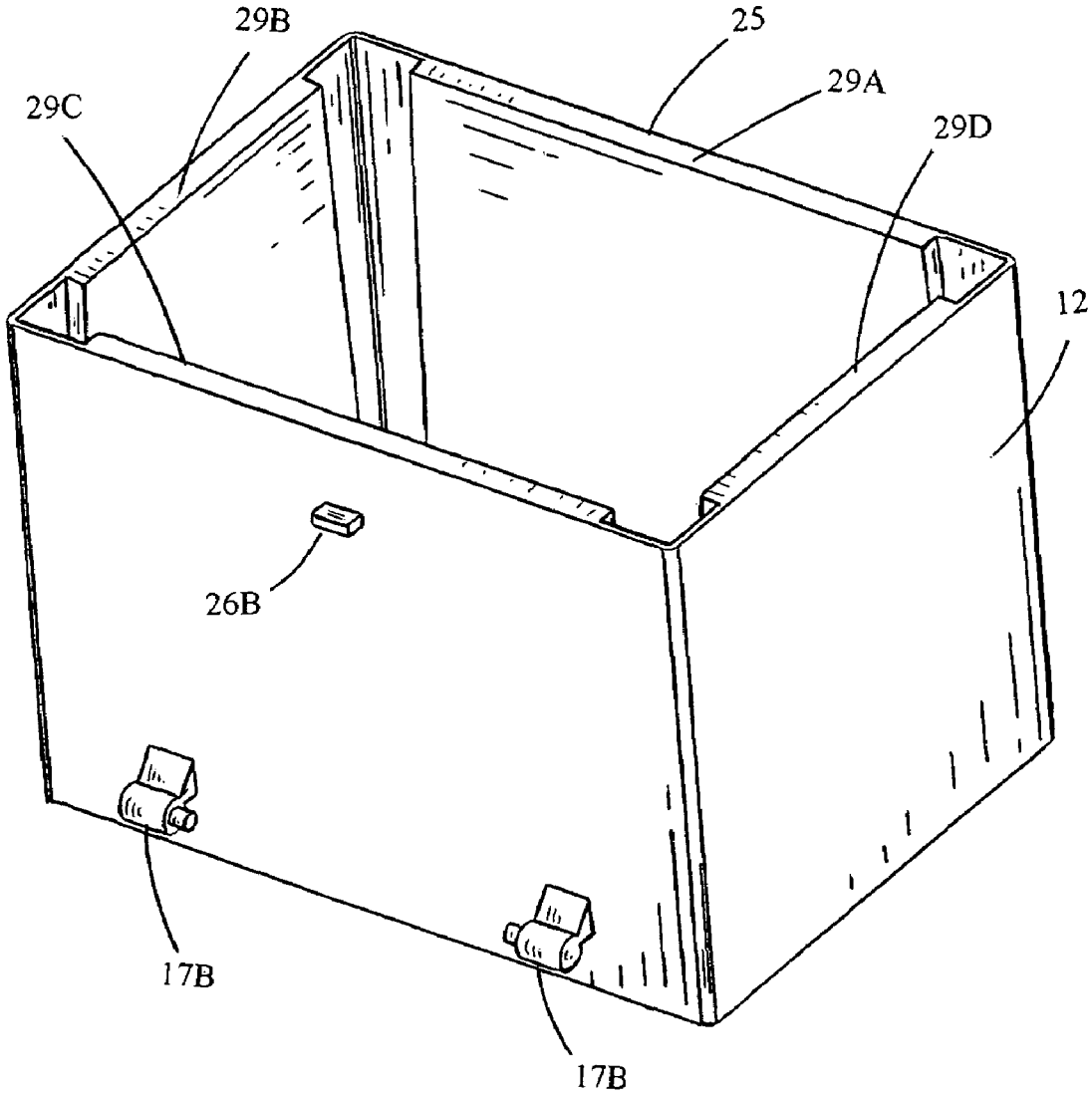
FIG. 7 is a perspective view of the display apparatus comprising a partitioned card box having a second card holder with card-fitting dimensions at an upright position.

FIG. 7 shows a perspective view of the display apparatus comprising a partitioned card box 12 having a second card holder 23 with card-fitting dimensions at an upright position. In a preferred embodiment, the card-fitting dimensions comprise a depth and a pair of four sides, each of the four sides comprising two parallel longitudinal sides and two parallel traverse sides forming a rectangle, wherein at least one of the four sides has a rectangular riser 29A, 29B, 29C, 29D attached to the side, each riser having dimensions of a riser height, a riser length and a riser width.

In one embodiment of the invention, the holder cap is provided to one card holder while the display-side holder may not mean to be opened. In another embodiment, the holder cap is provided to one card holder while the second holder may comprise a slot through which cards can slide in and out. The slot may be located at the first side or not at the first side. In still another embodiment, the opening and hinges can be positioned at the partition 18, instead of the first side or the opposite second side of the partitioned card box. In still another embodiment, the first holder cap is provided at a first side of the partitioned card box while the second holder cap is provided at a side away from the first side, but not opposite to the first side.

In operations for displaying and storing collectible cards, it is provided a method of holding and displaying collectible cards comprising: (a) providing a partitioned card box having a first card holder with a first holder cap at a first side of the partitioned card box and a second card holder with a second holder cap located at an opposite second side of the partitioned card box, wherein the first holder cap comprises a first latch mechanism and the second holder cap comprises a second latch mechanism; (b) turning the first card holder in an essentially upright position; (c) storing at least one collectible card inside the first holder and applying the first latch mechanism to securely holding the card; (d) turning the partitioned card box to enable the second card holder facing upward in an essentially upright position; and (e) storing a balance of the collectible cards inside the second holder and applying the second latch mechanism to securely holding the balanced collectible cards. The card can be readily removed from the display holder 13 at wish or if needed simply by removing the first card using the grasping means for picking up an edge of the cards. In one alternate embodiment, the card holder cap can be locked onto the card holder for permanent displaying. This type of permanently securing a valuable collectible card inside a display holder with an easily ready operation is obviously important. There won't be any dispute as to the quality or authenticity of the card once the card is placed in this secured display holder 13 of the present invention.

The partitioned card box 12 and its card holders 13, 23 possess sufficient stiffness so as to be capable of protecting the valuable card placed within. It is to be understood that the display holder could be constructed with a larger or smaller dimension as long as a card is reasonably placed within the recess portion of the holder without departing from the spirit and scope of the invention. The overall shape and dimension of the display holder can be configured as wish without departing from the spirit and scope of the invention.

It will be appreciated that it is one object of the present invention to provide a display apparatus comprising a partitioned card box having a first card holder with a first holder cap at a first side of the partitioned card box and a second card holder with a second holder cap located at a second side of the partitioned card box.

From the foregoing description, it should now be appreciated that a display apparatus for holding and displaying valuable collectible cards in a partitioned card box has been disclosed. While the invention has been described with reference to a specific embodiment, the description is illustrative of the invention and is not to be construed as limiting the invention. Various modifications and applications may occur to those who are skilled in the art, without departing from the true spirit and scope of the invention, as described by the appended claims.

What is claimed is:

1. A display apparatus for suitably holding collectible cards comprising a partitioned card box having a first card holder with a first holder cap at a first side of the partitioned card box and a second card holder with a second holder cap located at a second side of said partitioned card box, wherein the first card holder comprises a recessed portion having card-fitting dimensions for receiving the cards to be held, wherein the card-fitting dimensions comprise a depth and a pair of four sides that have two parallel longitudinal sides and two parallel traverse sides forming a rectangle, wherein at least one of said four sides has a riser, wherein each said riser has a riser surface, said riser surface being treated with friction reducing means for enabling easier card insertion or removal.

2. The display apparatus of claim 1, wherein each said riser comprises a shape selected from a group consisting of a rectangular shape, a triangular shape, and a trapezoid shape.

3. The display apparatus of claim 1, further comprising a latch or locking mechanism on the first or the second holder cap.

4. The display apparatus of claim 1, wherein the first holder cap or card holder is UV protective.

5. The display apparatus of claim 1, wherein the first holder cap or card holder is color coded.

6. The display apparatus of claim 1, wherein at least one of said card holders is equipped with means for card identification, inventory, and tracing with an electronic system, said means being selected from a group consisting of readable chips with preloaded data, embedded microchips with preloaded data, RF identifiers, and barcodes.

7. The display apparatus of claim 1, wherein said partitioned card box is made of a material selected from a group consisting of polyvinyl chloride, polyester, polycarbonate, polystyrene, polyether, acrylic, polymethylmethacrylate, and mixtures thereof.

8. The display apparatus of claim 1, wherein the card-fitting dimensions comprise a first depth for receiving one card to be held, wherein the first depth is equal to or slightly larger than the thickness of said one card.

9. The display apparatus of claim 1, wherein the first holder cap or card holder is transparent for display and viewing.

10. The display apparatus of claim 1, wherein the second holder cap or card holder is opaque for cards storage.

11. A method of holding and displaying collectible cards comprising:

providing a partitioned card box having a first card holder with a first holder cap at a first side of the partitioned card box and a second card holder with a second holder cap located at an opposite second side of said partitioned card box, wherein at least one of said card holders comprises a recessed portion having card-fitting dimensions for receiving the cards to be held wherein the card-fitting dimensions comprise a depth and a pair of four sides, wherein at least one of said four sides has a riser, wherein each said riser has a riser surface, said riser surface being treated with friction reducing means for enabling easier card insertion or removal;

turning the first card holder in a substantially upright position;

storing at least one collectible card inside the first holder;

turning the partitioned card box to enable the second card holder facing upward in an substantially upright position; and storing a balance of the collectible cards inside the second holder.

12. The method of claim 11, wherein each said riser comprises a shape selected from a group consisting of a rectangular shape, a triangular shape, and a trapezoid shape.

13. The method of claim 11, further comprising a latch or locking mechanism on the first or the second holder cap.

14. The method of claim 11, wherein the first holder cap or card holder is UV protective.

15. The method of claim 11, wherein the first holder cap or card holder is color coded.

16. The method of claim 11, wherein at least one of said card holders is equipped with means for card identification, inventory, and tracing with an electronic system, said means being selected from a group consisting of readable chips with preloaded data, embedded microchips with preloaded data, RF identifiers, and barcodes.

17. The method of claim 11, wherein said partitioned card box is made of a material selected from a group consisting of polyvinyl chloride, polyester, polycarbonate, polystyrene, polyether, acrylic, polymethylmethacrylate, and mixtures thereof.

18. The method of claim 11, wherein the card-fitting dimensions comprise a first depth for receiving one card to be held, wherein the first depth is equal to or slightly larger than the thickness of said one card.

19. The method of claim 11, wherein the first holder cap or card holder is transparent for display and viewing.

20. The method of claim 11, wherein the second holder cap or card holder is opaque for cards storage.

* * * * *